US009629427B1

(12) United States Patent
Alm

(10) Patent No.: US 9,629,427 B1
(45) Date of Patent: Apr. 25, 2017

(54) BEACH UMBRELLA SYSTEM

(71) Applicant: Steven J. Alm, Tampa, FL (US)

(72) Inventor: Steven J. Alm, Tampa, FL (US)

( * ) Notice: Subject to any disclaimer, the term of this patent is extended or adjusted under 35 U.S.C. 154(b) by 0 days.

(21) Appl. No.: 14/848,761

(22) Filed: Sep. 9, 2015

Related U.S. Application Data

(60) Provisional application No. 62/049,856, filed on Sep. 12, 2014.

(51) Int. Cl.
*A45B 23/00* (2006.01)
*E04H 12/22* (2006.01)
*A45B 25/00* (2006.01)

(52) U.S. Cl.
CPC ..... *A45B 23/00* (2013.01); *A45B 25/00* (2013.01); *A45B 2023/0012* (2013.01); *E04H 12/2223* (2013.01)

(58) Field of Classification Search
CPC . A45B 23/00; A45B 25/00; A45B 2023/0012; E04H 12/22; E04H 12/2223
USPC ..... 135/15.1, 16, 98, 118, 90, 5; 248/511, 248/518, 519, 530, 156; 52/157, 162–166
See application file for complete search history.

(56) References Cited

U.S. PATENT DOCUMENTS 2,441,109 A * 5/1948 Carlson ..... E04H 12/2223 248/156
3,512,319 A * 5/1970 Piacentino ..... E02D 5/803 52/160
5,152,495 A * 10/1992 Jacinto ..... E04H 12/223 135/98
5,156,369 A * 10/1992 Tizzoni ..... E04H 12/32 135/16
5,293,889 A * 3/1994 Hall ..... A45B 3/00 135/16
5,396,916 A * 3/1995 Boissonnault ..... A45B 7/005 135/16
5,482,246 A * 1/1996 Derkoski ..... E04H 12/2223 248/156
7,246,783 B2 * 7/2007 Harold ..... A45B 25/00 135/16
8,191,561 B2 * 6/2012 Brooks, III ..... E04H 12/2223 135/16
2008/0011498 A1 * 1/2008 Catlin ..... A01B 1/065 172/699
2008/0099061 A1 * 5/2008 McKnight ..... A45F 3/44 135/118

(Continued)

*Primary Examiner* — Winnie Yip

(57) ABSTRACT

A beach umbrella system. A winged anchor has an interior and exterior cylindrical components. The exterior cylindrical component has an open top, a cylindrical side wall, and a closed bottom. The cylindrical side wall has upper slots and lower slots. The lower slots each have a lateral enlargement. A cylindrical chamber is formed within the exterior cylindrical component. Shaped surfaces in the cylindrical chamber extend upwardly from the closed bottom. The interior cylindrical component is formed with an open top and a bottom with a pivot block. Two similarly configured wings are pivotably coupled to the pivot block. The interior cylindrical component and wings are movable together between a raised orientation and a lowered orientation. The raised orientation is with the wings positioned vertically within the exterior cylindrical chamber. The lowered orientation is with the wings positioned horizontally and extending exteriorly of the exterior cylindrical component.

1 Claim, 3 Drawing Sheets

(56) References Cited

U.S. PATENT DOCUMENTS

2008/0149358 A1* 6/2008 Catlin ..... A01B 1/065
172/41

* cited by examiner 10
32

16
14
30
20
18
26
24

66
76
74
34

BEACH UMBRELLA SYSTEM

RELATED APPLICATION

The present application is based upon and claims the benefit of Provisional Application No. 62/049,856 filed Sep. 12, 2014, the subject matter of which is incorporated herein by reference.

BACKGROUND OF THE INVENTION

Field of the Invention

The present invention relates to a beach umbrella system and more particularly pertains to boring into beach sand, for deploying to a secure orientation during use, and for retracting from the beach sand after use, the boring and deploying and retracting being done in a safe, convenient and economical manner.

Description of the Prior Art

The use of beach umbrella systems of known designs and configurations is known in the prior art. More specifically, beach umbrella systems of known designs and configurations previously devised and utilized for the purpose of anchoring beach umbrellas in sand are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a beach umbrella system that allows boring into beach sand, deploying to a secure orientation during use, retracting from the beach sand after use, in a safe, convenient, and economical manner.

In this respect, the beach umbrella system according to the present invention substantially departs from the conventional concepts and designs of the prior art, and in doing so provides an apparatus primarily developed for the purpose of boring into beach sand, deploying to a secure orientation during use, retracting from the beach sand after use, in a safe, convenient, and economical manner.

Therefore, it can be appreciated that there exists a continuing need for a new and improved beach umbrella system which can be used for boring into beach sand, deploying to a secure orientation during use, retracting from the beach sand after use, in a safe, convenient, and economical manner. In this regard, the present invention substantially fulfills this need.

SUMMARY OF THE INVENTION

In view of the disadvantages inherent in the known types of umbrellas of known designs and configurations now present in the prior art, the present invention provides an improved beach umbrella system. As such, the general purpose of the present invention, which will be described subsequently in greater detail, is to provide a new and improved beach umbrella system and method which has all the advantages of the prior art and none of the disadvantages.

The present invention in its broadest context includes a winged anchor having an interior cylindrical component and an exterior cylindrical component. The exterior cylindrical component has an open top and a cylindrical side wall and a closed bottom. The cylindrical side wall has upper slots and lower slots. The lower slots each have a lateral enlargement. A cylindrical chamber is formed within the exterior cylindrical component. Shaped surfaces are in the cylindrical chamber extending upwardly from the closed bottom. The interior cylindrical component is formed with an open top and a bottom with a pivot block. Two similarly configured wings are pivotably coupled to the pivot block. The interior cylindrical component and wings are movable together between a raised orientation and a lowered orientation. The raised orientation is with the wings positioned vertically within the exterior cylindrical chamber. The lowered orientation is with the wings positioned horizontally and extending exteriorly of the exterior cylindrical component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved beach umbrella system which has all of the advantages of the prior art beach umbrella systems of known designs and configurations and none of the disadvantages.

It is another object of the present invention to provide a new and improved beach umbrella system which may be easily and efficiently manufactured and marketed.

It is further object of the present invention to provide a new and improved beach umbrella system which is of durable and reliable constructions.

An even further object of the present invention is to provide a new and improved beach umbrella system which is susceptible of a low cost of manufacture with regard to both materials and labor, and which accordingly is then susceptible of low prices of sale to the consuming public, thereby making such beach umbrella system economically available to the buying public.

Lastly, it is still another object of the present invention is to provide a beach umbrella system for boring into beach sand, deploying to a secure orientation during use, retracting from the beach sand after use, in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
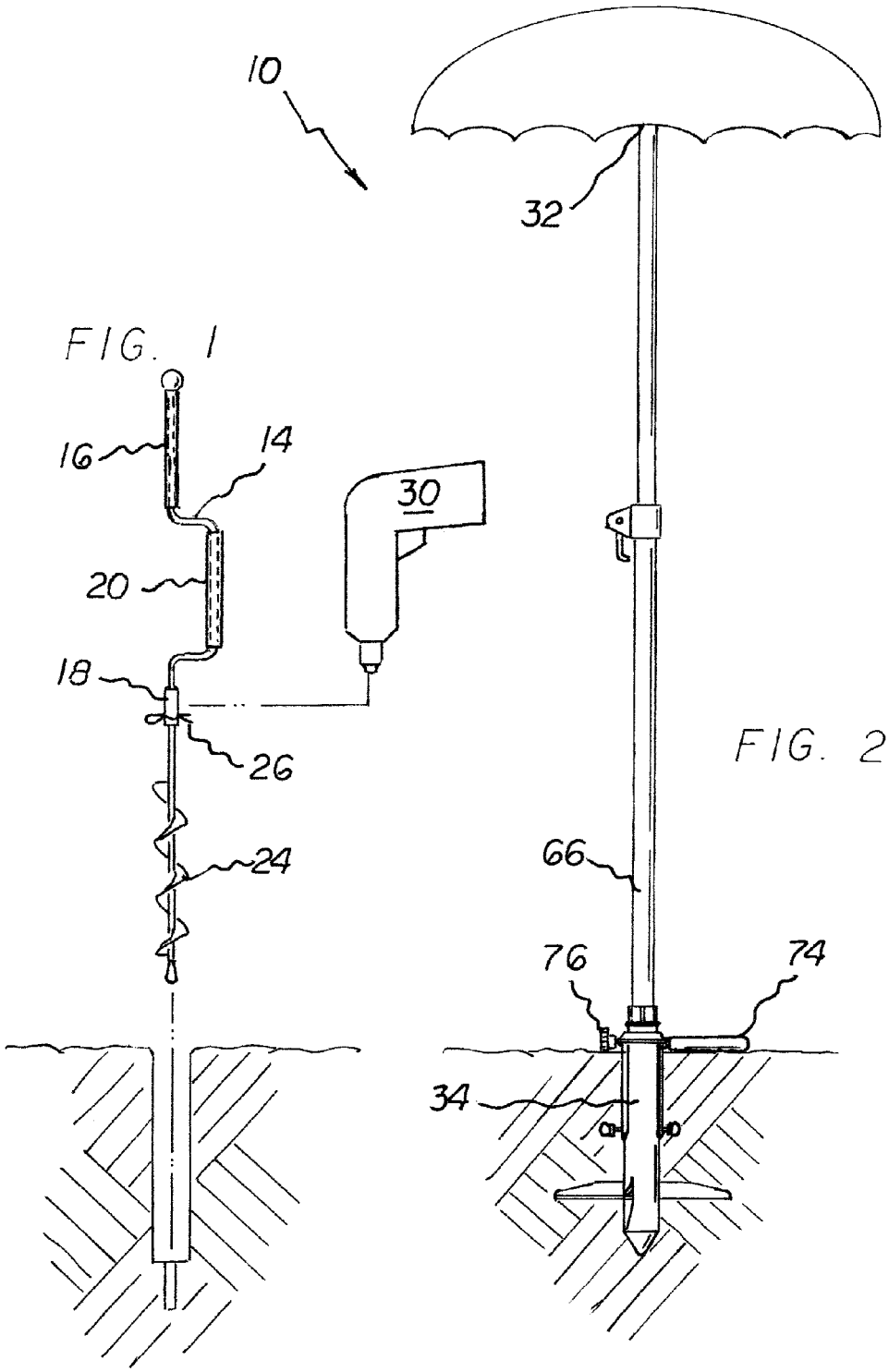
FIG. 1 is a front elevational view, partly exploded, of a beach umbrella system preparing for deployment, constructed in accordance with the principles of the present invention.
FIG. 2 is a front elevational view of a beach umbrella system during deployment.
Figure 3:
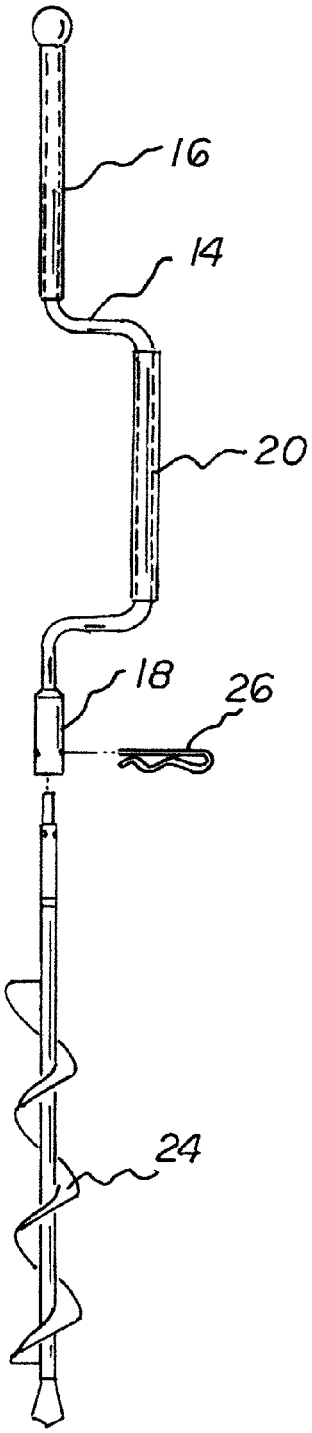
FIG. 3 is a front elevational view, partly exploded, of a manual crank and auger for forming a hole in the sand.
Figure 4:
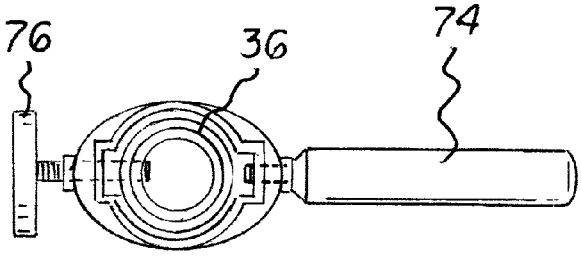
FIG. 4 is a plan view of the winged anchor taken along line 4-4 of FIG. 2.
Figure 5:
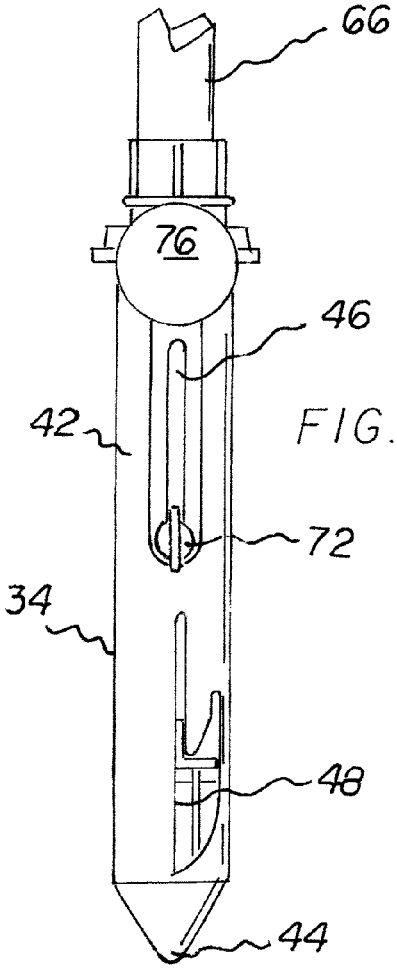
FIG. 5 is a side elevational view of the winged anchor taken along line 5-5 of FIG. 4.
Figure 6:
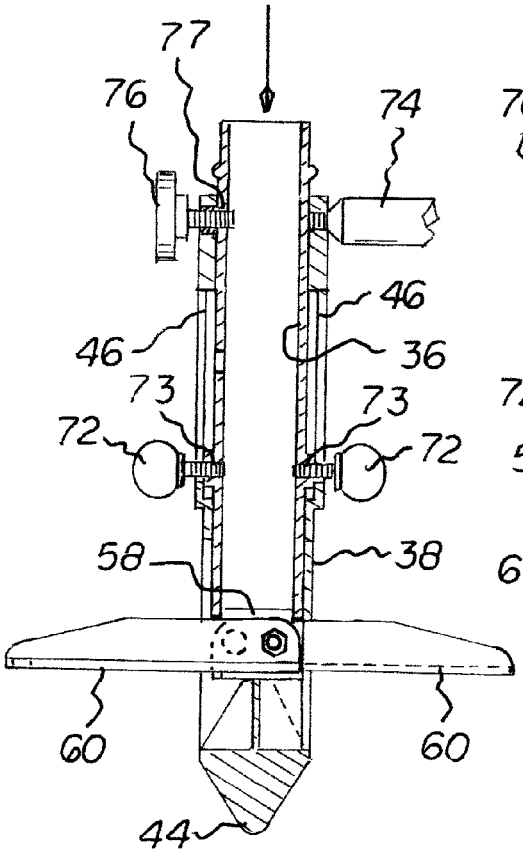
FIG. 6 is a cross sectional view of the anchor tool taken along line 6-6 of FIG. 5.
Figure 7:
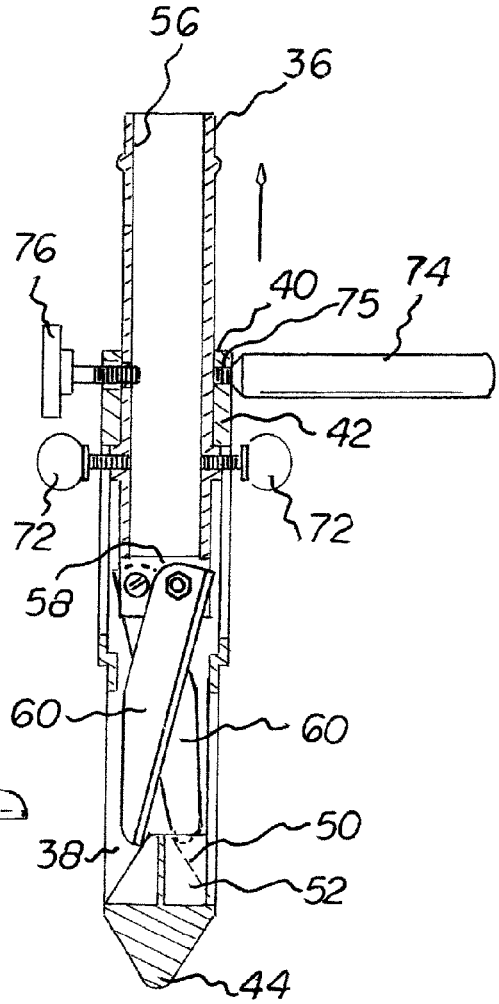
FIG. 7 is a cross sectional view of the anchor tool similar to FIG. 6 but with the wings withdrawn.

With reference now to the drawings, and in particular to FIG. 1 thereof, the preferred embodiment of the new and improved beach umbrella system embodying the principles and concepts of the present invention and generally designated by the reference numeral 10 will be described.

The present invention, the beach umbrella system 10 is comprised of a plurality of components. Such components in their broadest context include a winged anchor system having exterior and interior components. Such components are individually configured and correlated with respect to each other so as to attain the desired objective.

From a specific viewpoint, the present invention is a beach umbrella system 10 for boring into beach sand, for deploying to a secure orientation during use, and for retracting from the beach sand after use. The boring and deploying and retracting are done in a safe, convenient and economical manner. The system includes a manual crank 14 having a top rotating sleeve 16 and a bottom attachment end 18 and an intermediate offset rotating sleeve 20.

Next provided is an auger 24. The auger has an upper end operatively coupled to the bottom attachment end of the manual crank. A retaining pin 26 removably attaches the auger to the manual crank.

As an alternative to the hand crank, a cordless electrical drill 30 is provided. The cordless electric drill has a rotatable chuck adapted to removably couple to the auger. The auger is rotated by the manual crank and optionally by the cordless electric drill for creating a hole in the beach sand for supporting a beach umbrella 32.

Next provided is a winged anchor 34 positioned in the hole in the sand for supporting the beach umbrella. The winged anchor has an interior cylindrical component 36 and an exterior cylindrical component 38.

The exterior cylindrical component 38 is formed of a hollow tube having on open top 40 and a cylindrical side wall 42 and a closed bottom 44 terminating in a point. The cylindrical side wall has vertical upper slots 46 and vertical lower slots 48. The vertical lower slots each have a lateral enlargement. A cylindrical chamber 50 is formed within the exterior cylindrical component. Pyramid shaped surfaces 52 in the cylindrical chamber extending upwardly from the closed bottom.

The interior cylindrical component 36 is formed of a hollow tube 56 with an open top and a bottom with a pivot block 58. Two similarly configured wings 60 are pivotably coupled to the pivot block. The two similarly configured wings having an L-shaped cross sectional configuration. The interior cylindrical component and wings are movable together between a raised inoperative orientation and a lowered operative orientation. The raised inoperative orientation is with the wings positioned vertically within the exterior cylindrical component while inserting and withdrawing the winged anchor with respect to the hole in the sand. The lowered operative orientation is with the wings positioned horizontally and extending exteriorly of the exterior cylindrical component for maintaining the winged anchor within the hole in the sand.

The beach umbrella 32 is includes an umbrella pole 66 slidably received in the interior cylindrical component during use.

Thumb bolts 72 extend through the upper slots and are threadedly received in lower threaded apertures 73 in the interior cylindrical component. A handle 74 is threadedly received in a first upper threaded aperture 75 in the exterior cylindrical component above the upper slots. The handle is used to hold and stabilize the anchor system while inserting it into the hole in the sand. A knob with a securement bolt 76 is threadedly received in a second upper threaded aperture 77 adjacent to the open top of the exterior cylindrical component to releasably secure the umbrella pole to the exterior cylinder.

Downward movement of the beach umbrella pole and the interior cylindrical component functions to move the wings into sliding contact with the fixed pyramid shaped surfaces to project the wings to a horizontal orientation extending through the lower slots and lateral enlargements.

Upward movement of the beach umbrella pole and interior cylindrical component functions to move the wings into sliding contact with a peripheral edge of the lower slots and lateral enlargements to retract the wings to a vertical orientation within the exterior cylindrical component.

Instructions to drill a hole in the sand using your sand auger;

1. Brush off the loose sand from the location you wish to plant your winged anchor.

2. When using your manual crank that is attached to the sand auger, place one hand on the upper rotating sleeve and the other hand on the offset rotating sleeve while applying downward pressure on the handle. With both hands, rotate the offset area of the handle clockwise with one handle while using your other hand on the top sleeve to keep the auger in a vertical position. Drill the vertical hole to the required depth.

3. If you are using the sand auger with your cordless drill, first remove the crank handle by removing the retaining pin and then attach the sand auger to the cordless drill. Drill the vertical hole to a required depth 4. Caution: Do not touch the sand auger blades when attached to a cordless drill.

Instructions to attach the winged anchor to the beach umbrella pole:

1. For 0.75 inch beach umbrella poles first slide one centering rubber washer onto your beach umbrella pole approximately 8.0 inches from the bottom of the pole and slide the second centering rubber washer approximately 2.0 inches from the bottom of your beach umbrella pole.

2. Slide the beach umbrella pole fully into open end of winged anchor.

3. Alternately screw in anchor thumb screw and anchor thumb screw to ensure the beach umbrella pole remains centered in the winged anchor until the beach pole is adequately secured.

4. Caution: Do not use the winged anchor if wind gusts are expected to exceed the lesser of the rating of your beach umbrella or 20 miles per hour.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach umbrella system (10) for boring into beach sand, for deploying to a secure orientation during use, and for retracting from the beach sand after use, the boring and deploying and retracting being done in a safe, convenient, and economical manner, the system comprising, in combination:

a manual crank (14) having a top rotating sleeve (16) and a bottom attachment end (18) and an intermediate offset rotating sleeve (20);

an auger (24) having an upper end operatively coupled to the bottom attachment end of the manual crank, a retaining pin (26) removably attaching the auger to the manual crank;

an electrical drill (30) having a rotatable chuck adapted to removably couple to the auger, the auger being rotated by the manual crank and optionally by the electric drill for creating a hole in the beach sand for supporting a beach umbrella (32);

a winged anchor (34) positioned in the hole in the sand for supporting the beach umbrella, the winged anchor having an interior cylindrical component (36) and an exterior cylindrical component (38);

the exterior cylindrical component (38) being formed of a hollow tube having on open top (40) and a cylindrical side wall (42) and a closed bottom (44) terminating in a point, the cylindrical side wall having vertical upper slots (46) and vertical lower slots (48), the vertical lower slots each having a lateral enlargement, a cylindrical chamber (50) formed within the exterior cylindrical component, pyramid shaped surfaces (52) in the cylindrical chamber extending upwardly from the closed bottom;

the interior cylindrical component (36) being formed of a hollow tube (56) with an open top and a bottom with a pivot block (58), two similarly configured wings (60) pivotably coupled to the pivot block, the two similarly configured wings having an L-shaped cross sectional configuration, the interior cylindrical component and wings movable together between a raised inoperative orientation and a lowered operative orientation, the raised inoperative orientation being with the wings positioned vertically within the exterior cylindrical chamber while inserting and withdrawing the winged anchor with respect to the hole in the sand, the lowered operative orientation being with the wings positioned horizontally and extending exteriorly of the exterior cylindrical component for maintaining the winged anchor within the hole in the sand;

a beach umbrella (32) having an umbrella pole (66) slidably received in the interior cylindrical component during use; and thumb bolts (72) extending through the upper slots (46) and threadedly received in lower threaded apertures (73) in the interior cylindrical component, a handle (74) threadedly received in a first upper threaded aperture (75) adjacent to the exterior cylindrical component above the upper slots, a securement bolt (76) threadedly received in a second threaded aperture (77) adjacent to the open top of the exterior cylindrical component to releasably secure the umbrella pole to the exterior cylinder;

downward movement of the beach umbrella pole and the interior cylindrical component adapted to move the wings into sliding contact with the fixed pyramid shaped surfaces to project the wings to a horizontal orientation extending through the lower slots and lateral enlargements;

upward movement of the beach umbrella pole and interior cylindrical component adapted to move the wings into sliding contact with a peripheral edge of the lower slots and lateral enlargements to retract the wings to a vertical orientation within the exterior cylindrical component.

* * * * *